US006871712B2

(12) United States Patent
Koch et al.

(10) Patent No.: US 6,871,712 B2
(45) Date of Patent: Mar. 29, 2005

(54) REMOTE CONTROL FOR A DRILLING MACHINE

(75) Inventors: Geoff D. Koch, Perry, OK (US); Lee Widener, Perry, OK (US); David R. Payne, Perry, OK (US)

(73) Assignee: The Charles Machine Works, Inc., Perry, OK (US)

( * ) Notice: Subject to any disclaimer, the term of this patent is extended or adjusted under 35 U.S.C. 154(b) by 104 days.

(21) Appl. No.: 10/276,737

(22) PCT Filed: Jul. 18, 2001

(86) PCT No.: PCT/US01/22562

§ 371 (c)(1),
(2), (4) Date: Nov. 15, 2002

(87) PCT Pub. No.: WO02/06633

PCT Pub. Date: Jan. 24, 2002

(65) Prior Publication Data

US 2003/0205410 A1 Nov. 6, 2003

(51) Int. Cl.[7] ..... E21B 47/12

(52) U.S. Cl. ..... 175/26; 175/40; 175/103; 175/203

(58) Field of Search ..... 175/24, 26, 27, 175/40, 51, 103, 104, 162, 203

(56) References Cited

U.S. PATENT DOCUMENTS

| | | | | |
|---|---|---|---|---|
| 3,680,412 | A | 8/1972 | Mayer et al. | 81/57.34 |
| 3,778,107 | A | 12/1973 | Haspert | 299/11 |
| 4,192,551 | A | 3/1980 | Weimer et al. | 299/1 |
| 4,449,592 | A | 5/1984 | Mayer | 175/52 |
| 4,552,331 | A | 11/1985 | Smart, Jr. | 251/95 |
| 4,621,974 | A | 11/1986 | Krueger | 414/786 |
| 4,698,634 | A | 10/1987 | Alongi et al. | |
| 4,710,708 | A | 12/1987 | Rorden et al. | 324/207 |
| 4,881,083 | A | 11/1989 | Chau et al. | 342/459 |
| 4,898,251 | A | 2/1990 | Clark et al. | 175/27 |
| 4,907,658 | A | 3/1990 | Stangl et al. | 175/19 |
| 4,955,439 | A | 9/1990 | Kinnan | 175/45 |
| 5,015,124 | A | 5/1991 | Perry | 405/184 |
| 5,065,098 | A | 11/1991 | Salsman et al. | 324/326 |
| 5,065,825 | A | 11/1991 | Bardin et al. | 175/38 |
| 5,469,155 | A | 11/1995 | Archambeault et al. | 340/853.4 |
| 5,553,680 | A | 9/1996 | Hathaway | 175/78 |
| 5,610,818 | A | 3/1997 | Ackroyd et al. | 364/424.07 |
| 5,638,619 | A | 6/1997 | Bowling | 37/302 |
| 5,698,981 | A | 12/1997 | Mercer | 324/329 |
| 5,699,514 | A | 12/1997 | Durinovic-Johri et al. | 395/188.01 |
| 5,706,896 | A | 1/1998 | Tubel et al. | 166/313 |

(Continued)

FOREIGN PATENT DOCUMENTS

| | | | |
|---|---|---|---|
| EP | 0 428 180 A1 | 5/1991 | E21B/47/022 |
| WO | WO 0144614 A2 | 6/2001 | |
| WO | WO 0206633 A1 | 1/2002 | E21B/47/12 |

OTHER PUBLICATIONS

The Publication Entitled "Lockout–Tagout Protection For Trenchless Operations", dated Nov., 1997 by es!lok.

*Primary Examiner*—Zakiya Walker
(74) *Attorney, Agent, or Firm*—McKinney & Stringer, P.C.

(57) ABSTRACT

A method and apparatus for remotely controlling a machine. A remote operator controls a tracking device including a signal system for selectively emitting a remote enable signal. The remote enable signal is relayed to a control system for the machine. The control system is proximate to the machine and is adapted to enable at least one action of the machine upon detecting the remote enable signal. The machine is also adapted to disable the same action of the drilling machine upon detecting an absence of the remote enable signal for a predetermined number of intervals, each interval being of a preselected duration.

79 Claims, 7 Drawing Sheets

U.S. PATENT DOCUMENTS

| | | | | |
|---|---|---|---|---|
| 5,746,278 | A | 5/1998 | Bischel et al. | 175/24 |
| 5,764,062 | A | 6/1998 | Mercer | 324/329 |
| 5,767,678 | A | 6/1998 | Mercer | 324/326 |
| 5,904,210 | A | 5/1999 | Stump et al. | 175/45 |
| 5,937,954 | A | 8/1999 | Puttmann et al. | 175/61 |
| 5,944,121 | A | 8/1999 | Bischel et al. | 175/24 |
| 5,954,143 | A | 9/1999 | McCabe et al. | 173/184 |
| 6,012,536 | A | 1/2000 | Puttmann et al. | 175/21 |
| 6,030,169 | A | 2/2000 | Rossow et al. | 414/680 |
| 6,035,951 | A | 3/2000 | Mercer et al. | 175/45 |
| 6,079,506 | A | 6/2000 | Mercer | 175/75 |
| 6,285,860 | B1 | 9/2001 | Szarka et al. | 455/66 |
| 6,308,787 | B1 | 10/2001 | Alft | 175/48 |
| 6,408,952 | B1 | 6/2002 | Brand et al. | 175/24 |
| 2002/0081975 | A1 | 6/2002 | Szarka et al. | 455/66 |

REMOTE CONTROL FOR A DRILLING MACHINE

CROSS REFERENCE TO RELATED APPLICATION

This application claims the benefit of U.S. Provisional Application No. 60/219,091, filed on Jul. 18, 2000, the contents of which are incorporated fully herein by reference.

FIELD OF THE INVENTION

The present invention relates to the field of horizontal directional drilling, and more particularly but not by way of limitation, to an apparatus and associated method for controlling a horizontal directional drilling machine.

BACKGROUND OF THE INVENTION

Horizontal directional drilling machines are used to install underground utilities or other objects. This method is gaining widespread favor because it minimizes ground surface disruption and the likelihood of damaging already-buried objects.

Horizontal directional drilling operations generally consist of using the drilling machine which advances a drill string through the subterranean earth along a preselected path. The path is ordinarily selected so as to avoid already-buried objects such as buried utilities. Certain aspects of the drilling machine and the manner with which it acts on the drill string are included in U.S. Pat. No. 6,085,852 and U.S. Pat. No. 5,799,740, the contents of both are incorporated by reference herein.

The drilling machine generally comprises a frame, an anchoring system, a drive system mounted to the frame and connectable to the uphole end of the drill string, and a bit connected to the downhole end of the drill string. The drive system provides thrust and rotation to the drill string which, in turn, thrusts and rotates the boring tool through the subterranean earth, forming a borehole. The drive system generally comprises one or more power sources for thrusting and rotating the drill string. The boring tool is advanced in a substantially straight line direction by a simultaneous rotating and thrusting of the drill string by the drive system. To change the direction, conventional steering techniques are used such as are associated with a slant-faced bit. This type of bit is, after being oriented in the desired direction, advanced without drill string rotation to change the course of the borehole.

The drill string is extended by adding a series of drill pipe sections to the drill string. A signaling tracking device, or beacon, is conventionally placed in the boring tool at the downhole end of the drill string. In this manner, an above-ground remote operator can, with the assistance of a hand-held transceiver device (commonly referred to as a walk-over tracking device), monitor the location of the boring tool as it is extended to form the borehole.

When the borehole is completed, typically the bit is replaced with a backreaming tool which is pulled back through the borehole to pack and finally size the borehole. The tracking device and beacon may or may not be used to track the backreaming tool.

There are times when the operating personnel must gain access to the downhole end of the drill string, such as by excavating a pit where the boring tool is expected to cross above or below an existing underground object, such as a pipeline. The operator of the tracking device can then visually observe the approaching boring tool so as to ensure it is on a drilling path that will not collide with the underground object. At other times, the operator must gain access to the downhole end of the drill string in order to replace a worn or broken boring tool or at the end of the bore, replace the boring tool with a backreaming tool. At these times it would be useful for this remotely positioned operator to have some means for stopping or preventing advance and/or rotation of the drill string. As will be seen below, the present invention fulfills this need.

SUMMARY OF INVENTION

The present invention comprises a method and apparatus for remotely controlling an action of a horizontal directional drilling machine.

In one aspect the invention is a system for moving a downhole tool along a subsurface path having an origination point. The system comprises a drive assembly adapted to move the downhole tool with a tracking signal source. The tracking signal source is disposed adjacent the downhole tool and is adapted to generate and transmit a tracking data signal to a signal system. The signal system is positionable at a remote location from the origination point, and relays signals to a control system for the drive assembly. The drive assembly has an enabled mode, in which the drive assembly can actuate at least one kinematic component of downhole tool motion, and a disabled mode, in which the drive assembly cannot actuate the same at least one kinematic component of downhole tool motion.

The signal system herein comprises a tracking data detector adapted to detect the tracking data signal, a remote enable signal generator adapted to generate a remote enable signal, and a transmitter system adapted to relay the tracking data signal and the remote enable signal to the control system. The control system comprises a receiver system adapted to receive the remote enable and tracking data signals, a control subsystem adapted to control the drive assembly only while that system is in its enabled mode, and a remote disable subsystem, responsive to the receiver system, which places the drive assembly in its disabled mode in response to a designated interruption in reception of the remote enable signal.

In another aspect the invention comprises a signal system for remotely controlling an action of a machine having a drive assembly. The drive assembly is operable by a control system between an enabled mode and a disabled mode and is adapted to move a downhole tool operably connected to a tracking data signal source. The tracking data signal source emits a tracking data signal as the downhole tool is moved along a subsurface path from an origination point.

The signal system comprises a tracking data detector adapted to detect the tracking data signal, a remote enable signal generator adapted to generate and transmit a remote enable signal, and a transmitter system adapted to relay the remote enable signal and the tracking data signal to the control system. The signal system will control the drive assembly only when it relays the remote enable signal to the control system.

In another aspect the invention comprises a control system for a drive assembly of a machine. The control system is adapted to control movement of a downhole tool along a subsurface path from an origination point in response to a remote enable signal. The remote enable signal is received from a signal system positioned at a location remote from the origination point. The control system comprises a receiver system adapted to receive the remote enable signal, a control subsystem adapted to control the drive assembly and a remote disable subsystem that is responsive to the receiver system.

The drive assembly is adapted to having an enable mode in which the drive assembly can actuate at least one kinematic component of the downhole tool motion, and a disabled mode in which the drive assembly cannot actuate the same at least one kinematic component of the downhole tool motion. Furthermore, the control subsystem can only control the drive assembly while that system is in its enabled mode. Whereas, the remote disable subsystem will place the drive assembly in its disabled mode in response to a designated interruption in reception of the remote enable signal.

In yet another aspect, the present invention is a system comprising a downhole tool, a drive assembly adapted to move the downhole tool along a subsurface path from an origination point, a signal system positionable at a remote location from the origination point, and a control system. The drive assembly has an enabled mode and a disabled mode. In the enabled mode, the drive assembly can actuate at least one kinematic component of the downhole tool motion. Whereas, in the disabled mode, the drive assembly cannot actuate the same at least one kinematic component of the downhole tool motion. The signal system herein comprises a remote enable signal generator adapted to generate a remote enable signal and a transmitter system adapted to relay the remote enable signal to the control system.

The control system comprises a receiver system adapted to receive the remote enable signal, a control subsystem adapted to control the drive assembly only while that system is in its enabled mode, and a remote disable subsystem. The remote disable subsystem is responsive to the receiver system, wherein the remote disable system will place the drive assembly in its disabled mode in response to a designated interruption in reception of the remote enable signal. Furthermore, the control system comprises an override key which can be rendered inaccessible to personnel at the path origination site and an override lock system adapted to disable the remote disable system in response to actuation by the override key.

In still another aspect the invention comprises a system for moving a downhole tool along a subsurface path having an origination point. The system comprises a drive assembly adapted to move the downhole tool, a signal system, positionable at a remote location from the origination point, and a control system. The drive assembly has an enabled mode and a disabled mode. In the enabled mode, the drive assembly can actuate at least one kinematic component of the downhole tool motion. Whereas, in the disabled mode, the drive assembly cannot actuate the same at least one kinematic component of the downhole tool motion.

The signal system described herein comprises a remote enable signal generator adapted to generate a remote enable signal including an identification code selectable by a user of the system and a transmitter system adapted to relay the remote enable signal to the control system. The control system comprises a receiver system adapted to receive the remote enable signal and distinguish that signal from those which lack the user selectable identification code and signal. Furthermore, the control system comprises a control subsystem, adapted to control the drive assembly only while that system is in its enabled mode and a remote disable subsystem responsive to the receiver system. The remote disable subsystem will place the drive assembly in its disabled mode in response to a designated interruption in reception of the remote enable signal.

Yet in another aspect the invention is a system comprising a downhole tool, a drive assembly adapted to move the downhole tool, a signal system positionable at a remote location spaced from the origination point, and a control system. The drive assembly has an enabled mode and a disabled mode. In the enabled mode, the drive assembly can actuate at least one kinematic component of the downhole tool motion. Whereas, in the disabled mode, the drive assembly cannot actuate the same at least one kinematic component of the downhole tool motion.

The signal system described herein comprises a remote enable signal generator adapted to generate a remote enable signal and a transmitter system adapted to relay the remote enable signal to the control system. The control system comprises a receiver system adapted to receive the remote enable signal, a control subsystem adapted to control the drive assembly only while that assembly is in its enabled mode, and a remote disable subsystem. The remote disable system is responsive to the receiver system, and will place the drive assembly in its disabled mode in response to a designated interruption in reception of the remote enable signal. Furthermore, the control system comprises a remote feedback system adapted to signal the mode of the drive assembly to the remote location.

In still another aspect the invention is a system for moving a downhole tool along a subsurface path having an origination point. The system comprises a drive assembly, a signal system, a control system, and an on override lock system. The drive assembly is adapted to move the downhole tool. The drive assembly is configured to have an enabled mode and a disabled mode. In the enabled mode, the drive assembly can actuate at least one kinematic component of downhole tool motion. In the disabled mode, the drive assembly cannot actuate the same at least one kinematic component of downhole tool motion.

The signal system is positionable at a remote location from the origination point. The signal system comprises a remote enable signal generator and a transmitter system. The remote enable signal generator is adapted to generate a remote enable signal and the transmitter system is adapted to relay the remote enable signal. The control system comprises a receiver system, a remote disable subsystem, and a control subsystem. The receiver system is adapted to receive the remote enable signal. The remote disable subsystem is responsive to the receiver system and places the drive assembly in its disabled mode in response to a designated interruption in reception of the remote enable signal.

The control subsystem is adapted to control the drive assembly in response to a control input from the origination point. The override lock system is configured to have an actuated mode and a deactuated mode. When the override lock system is in the actuated mode, the control subsystem is rendered unresponsive to the control input from the origination point. When the override lock system is in the deactuated mode, the control subsystem is rendered responsive to such input.

BRIEF DESCRIPTION OF THE DRAWINGS

FIG. 6 is a flow chart diagram of a portion of the drilling machine control system that is responsive to a remote enable signal to selectively enable the drive system.

DETAILED DESCRIPTION OF THE PREFERRED EMBODIMENTS

Figure 1:
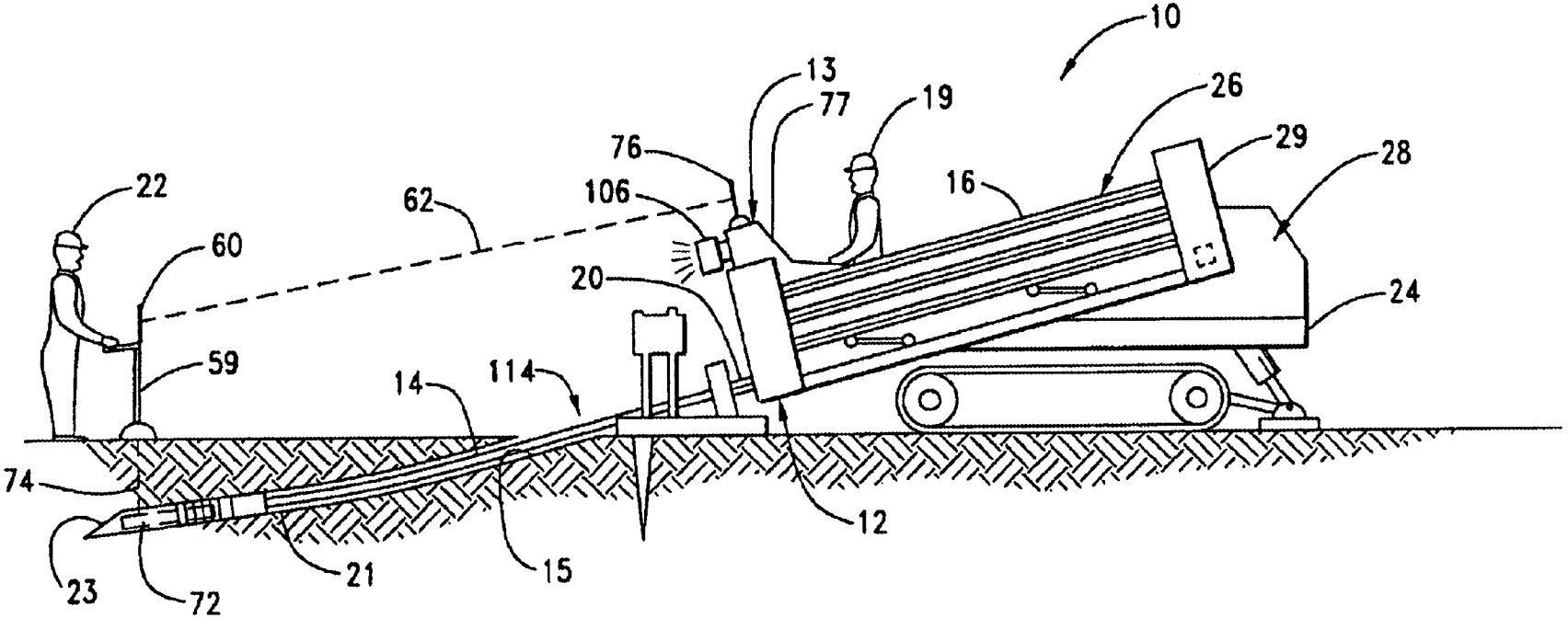
FIG. 1 is a diagrammatic representation of a remotely controlled horizontal directional drilling system constructed in accordance with the present invention.

Turning now to the drawings in general, and to FIG. 1 in particular, shown therein is a horizontal directional drilling system 10, that is constructed in accordance with the present invention. While the invention is described in connection with a horizontal directional drilling system 10 illustrated in FIG. 1, it is to be understood that the present invention can be readily adapted for use with other systems. The horizontal directional drilling system 10 generally comprises a drilling machine 12 which, in response to a control system 13, actuates a drilling member, such as a drill string 14, in order to produce a subterranean borehole 15.

The drilling machine 12 can be operated both in a drilling mode and in a backreaming mode. In the drilling mode, the control system 13 controls components of the drilling machine 12 to join sections of pipe 16 in forming the drill string 14 and extending the drill string 14 along a desired subsurface bore path. In the backreaming mode, the control system 13 controls components of the drilling machine 12 in withdrawing the drill string 14 from the borehole 15 and breaking the sections of pipe 16 apart. In many instances, a drilling operation performed while the drilling machine 12 is in the drilling mode, is followed by a backreaming operation, performed while the drilling machine is in a backreaming mode.

The control system 13 is generally responsive to the input of one or more operator personnel. There are times when it is preferable to have the control system 13 be completely responsive to the manual control of a drilling machine operator 19 stationed at the drilling machine 12. There are other times, however, when it is preferable to have the control system 13 be responsive to the input from an operator stationed remotely from the drilling machine 12. This latter condition prevails, for example, when a remote operator 22 or other assisting personnel (not shown) are changing tools (later described) or otherwise servicing the downhole end 21 of the drill string 14. Another example is when the downhole end 21 of the drill string 14 is passing by an object, such as a buried pipeline (later described).

Focusing now on the action of the drilling machine 12 on the drill string 14, an uphole end 20 of the drill string 14 is operably connected to the drilling machine 12 for imparting driving forces, such as rotation and thrust forces, to the drill string 14. The downhole end 21 of the drill string 14 supports a tool for forming or finishing the borehole 15. A slant-faced drilling bit 23 or a tri-cone bit (not shown), for example, illustrate tools commonly used in forming the borehole 15 in the subterranean earth. A reaming tool (not shown), for example, is a tool commonly used to finish the borehole during withdrawal of the drill string 14 from the borehole 15, by cutting, expanding, or packing, and thereby finally sizing the borehole 15.

The drilling machine 12 performs what are generally referred to as makeup and breakout operations on the drill string 14. "Makeup operations" refers to operations associated with assembling the drill string 14 from the drilling machine 12 for example, for extending it along the desired bore path, wherein individual pipes 16 are moved from a storage condition and connected to the drill string 14. "Breakout operations" refers to operations associated with disassembling the drill string 14 for example, for withdrawing it to from the borehole 15, wherein individual pipes 16 are disconnected from the drill string 14 and returned to the storage condition.

Figure 2:
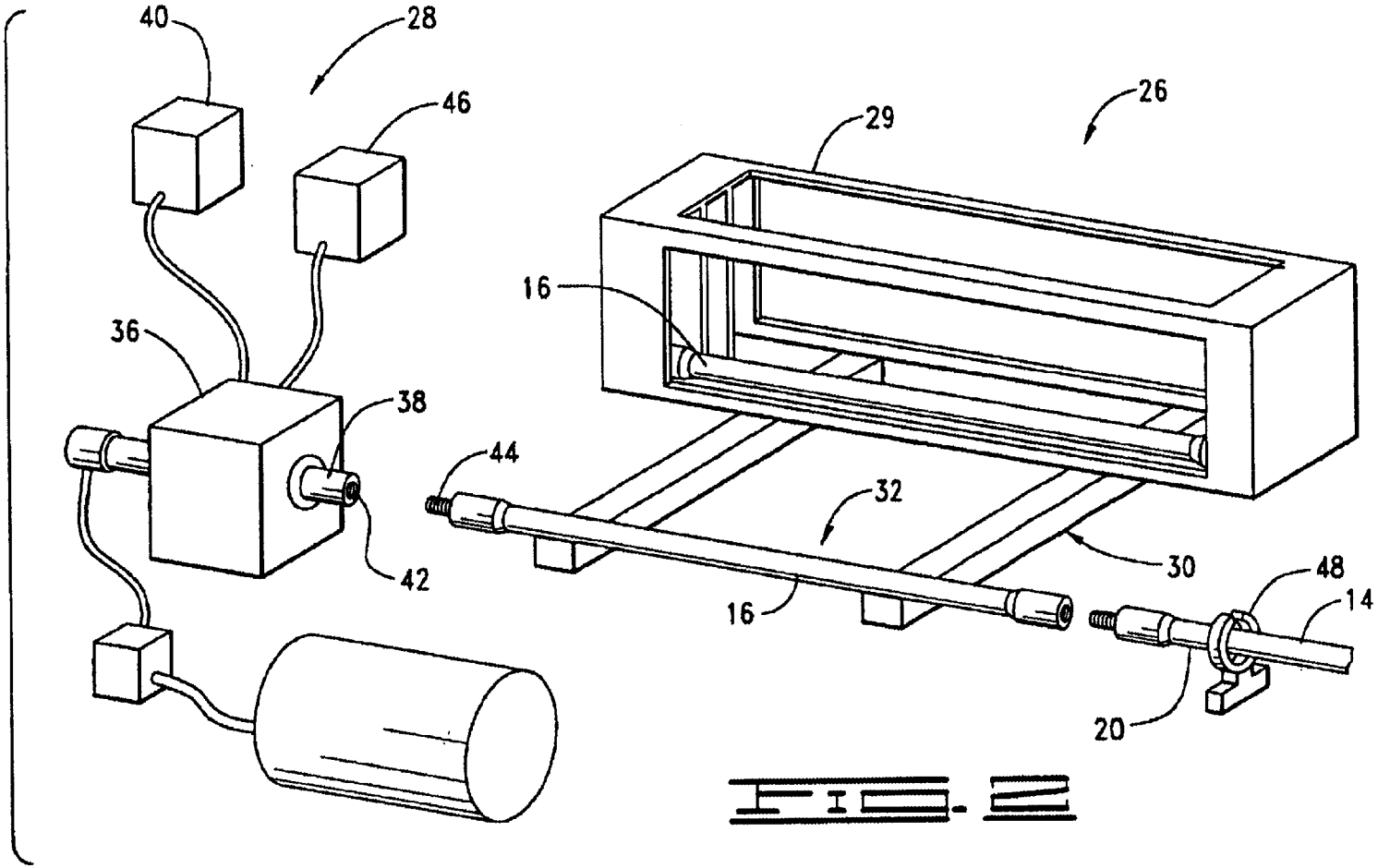
FIG. 2 is a diagrammatic representation of the drive system and the pipe handling system of the drilling machine of FIG. 1.

The drilling machine 12 of FIG. 1 may have a central frame 24 supporting a pipe handling assembly 26 that is operably adjacent a drive assembly 28. FIG. 2 more particularly shows the pipe handling assembly 26 comprises a pipe storage device, such as a pipe rack 29, for storage of a plurality of the pipes 16. Also, a pipe delivery assembly 30 moves individual pipes 16 between the pipe rack 29 and a makeup/breakout position 32.

The following describes various operations of the drilling machine 12 associated with the makeup operations. During makeup operations, the pipe 16 in the makeup/breakout position 32 is moved by the pipe delivery assembly 30 so as to be positioned between the uphole end 20 of the drill string 14 and the drive assembly 28.

The drive assembly 28 connects the pipe 16 to the drill string 14 and then imparts a driving force to the drill string 14. The drive assembly 28 of FIG. 2, for example, has a carriage 36 supporting a rotatable drive spindle 38. The carriage 36 is slidably supported by the central frame (not shown in FIG. 2) for longitudinal movement of the carriage 36 in a direction which substantially coincides with the longitudinal axis of the pipe 16 in the makeup/breakout position 32.

The carriage 36 is generally moved by a power source. For example, the carriage of FIG. 2 may be moved longitudinally by a thrust power unit 40. The thrust power unit 40 can be, for example, a hydraulic cylinder that is responsive to pressurized hydraulic fluid and operably connected to the carriage 36. Other arrangements of fluid, electrical or mechanical devices can be equivalently employed for longitudinally moving the carriage 46.

The pipes 16 can be joined end-to-end in any manner providing sufficient strength to the drill string 14 to maintain its structural integrity and extend and withdraw the drill string 14 as required. In FIG. 2, for example, the pipes 16 are threadingly connected. Accordingly, the drive spindle 38 is provided with a threaded portion 42 that is matingly engageable with a threaded portion 44 of the pipe 16. The carriage 36 is longitudinally advanced by a thrust power unit 40 so as to be adjacent the pipe 16, and the drive spindle 38 is rotated relative to the pipe 16 by a power source in order to threadingly engage the threaded portions 42, 44. For example, the drive spindle 38 of FIG. 2 can be rotated by a rotation power unit 46. The rotation power unit 46 can be, for example, a hydraulic motor that is responsive to pressurized hydraulic fluid and operably connected to the drive spindle 38. Other arrangements of fluid, electrical or mechanical devices can be equivalently employed for rotating the drive spindle 38.

In this manner, the thrust power unit 40 and the rotation power unit 46 can be selectively activated to move the drive spindle 38 into a threading engagement with one end of the pipe 16. Thereafter, the thrust power unit 40 and rotation power unit 46 can advance and rotate the pipe 16 to place the opposing end of the pipe into a threading engagement with the uphole end 20 of the drill string 14. Thereafter, the thrust power unit 40 and the rotation power unit 46 can selectively impart respective driving forces for advancing the drill string 14 through the subterranean earth.

Operation of the drilling machine during breakout operations are similar to those during makeup but with a reversal of the directions of movement during the breakout operations. That is, the thrust power unit 40 and rotation power unit 46 can be selectively activated to withdraw the drill string 14 from the borehole 15. The uppermost pipe 16 can be disconnected from the drill string 14 with the cooperation of one or more backup members 48, and the disconnected pipe can then be transferred from the makeup/breakout position 32 to the pipe storage rack 29 by the pipe delivery assembly 30.

Turning now to the operators' control of the drilling machine 12 operations, FIG. 1 illustrates the drilling machine operator 19 providing input commands to the control system 13 by way of conventional control members such as levers, joysticks and the like (not shown). The control system 13, in response, controls the corresponding components of the drilling machine 12, including but not limited to the thrust power unit 40 and the rotation power unit 46 (FIG. 2). The drilling machine operator 19 can steer the drill string 14, in one of several manners known by those skilled in the art, along the desired bore path by selectively thrusting and rotating the drill string 14.

Figure 3:
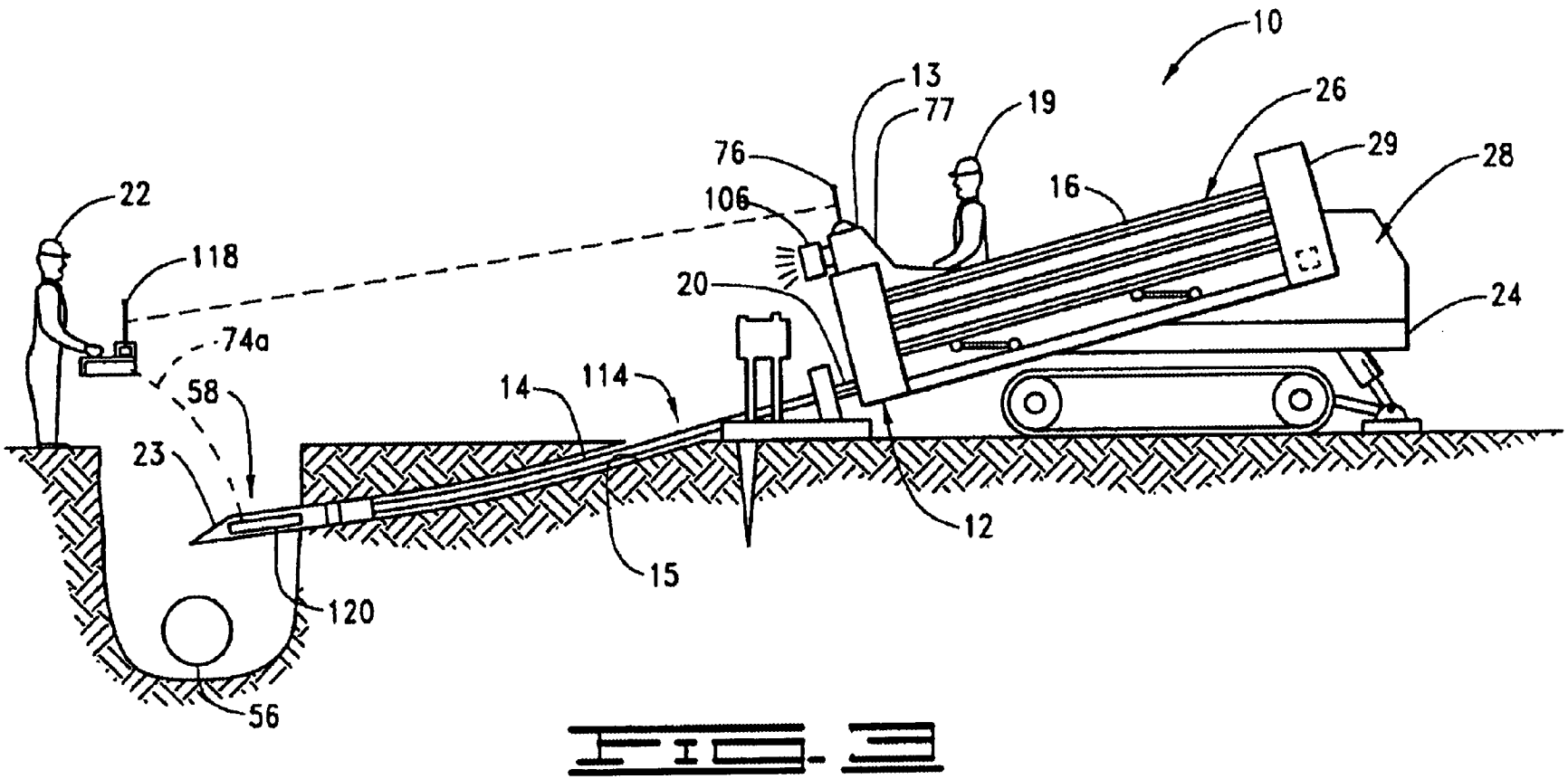
FIG. 3 is a diagrammatic representation of the horizontal directional drilling machine of FIG. 1 being remotely disabled by a remote operator while visually monitoring the progress of the advancing drill string.

Sometimes it is advantageous to have a remote operator 22 visually observe the advancement of the downhole end 21 of the drill string 14. For example, FIG. 3 is the horizontal directional drilling system of FIG. 1 shown drilling into a trench 58 that has been excavated to reveal an underground pipeline 56. The visual access provided by the trench 58 permits the remote operator 22 to directly view what the drilling machine operator 19 cannot see—the spatial relationship between the advancing drilling bit 23 and the pipeline 56. As the drilling machine operator 19 slowly extends the drill string 14 into the pit 58, the remote operator 22 can directly verify that the desired clearance exists, such that the drilling bit 23 will clear the pipeline 56 without damaging it.

The present invention provides the remote operator 22 with the ability to remotely control certain actions of the drilling machine 12. This permits the remote operator 22 to directly control certain drilling machine 12 actions that are otherwise controlled by the drilling machine operator 19.

One function that can be advantageously controlled by the remote operator 22 is the enablement or disablement of the drive assembly 28 of the drilling machine 12. When "enabled," the drive assembly 28, for example the thrust power unit 40 or the rotation power unit 46, is operably responsive to the drilling machine operator's 19 control. When "disabled" the drive assembly 28 is operably disabled and thus no longer responsive to the drilling machine operator's 19 control.

Generally, the present invention provides the remote operator 22 with an input device for selectively sending a remote enable signal to the control system 13 to enable the drive assembly 28. Absence of the remote enable signal under preselected conditions disables the drive assembly 28. In one embodiment the remote input device can be electrically connected to the control system 13 by a conductor such as an electrical wire. FIG. 1, however, preferably illustrates the remote operator 22 controlling a hand-held tracking device 59 having an integral transceiver 60. The transceiver 60 transmits a remote enable wireless signal 62 in the manner of a conventional wireless transmitter, such as, but not limited to, a radio-frequency transmitter or an infrared transmitter.

The tracking device 59 is thus used in a conventional manner to detect a signal from a beacon 72 at the downhole end 21 of the drill string 14, such as a tracking data signal 74. The tracking data signal 74 provides tracking information such as downhole tool location, depth, roll angle, pitch, temperature and battery status. The tracker 59 transmits the information to a receiver 76 on the drilling machine 12. The control system 13 processes the information and displays it in a useful format on a display 77 for the drilling machine operator 19.

Figure 4:
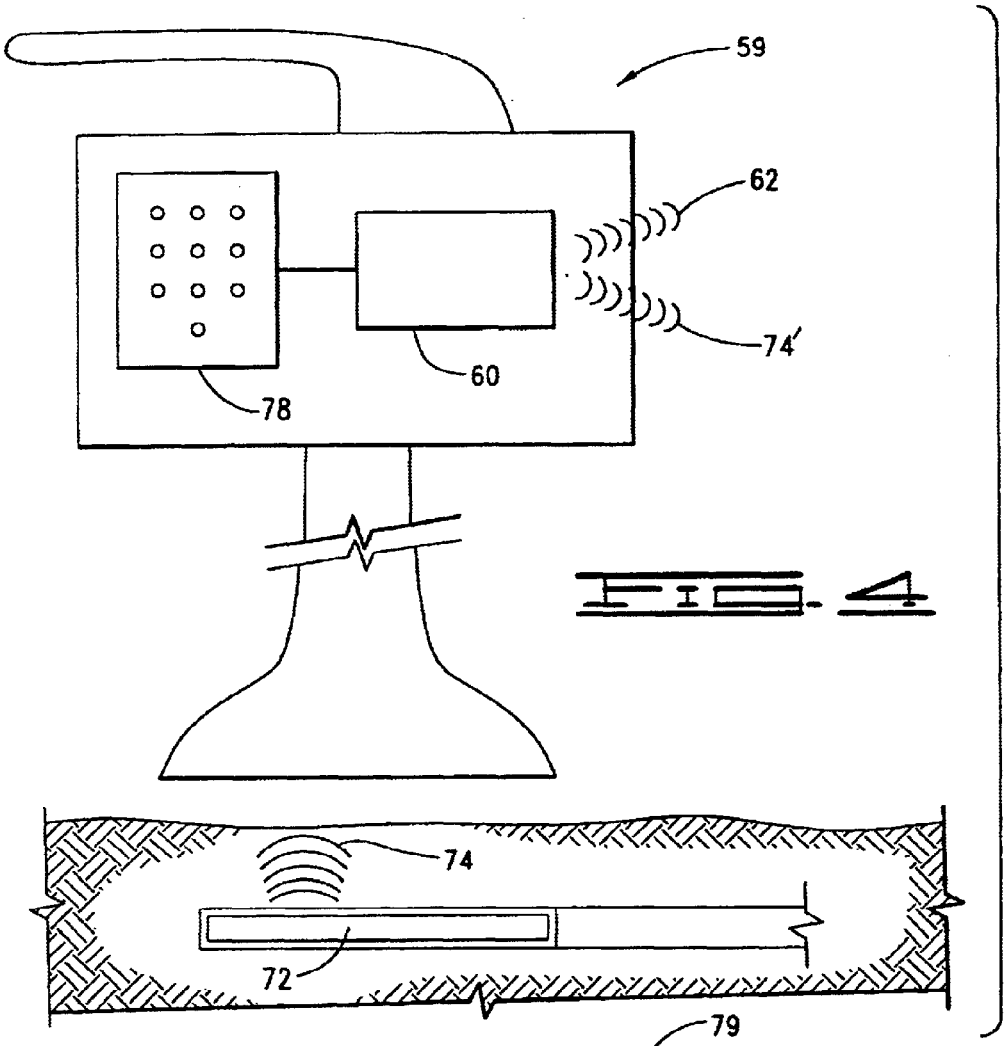
FIG. 4 is a diagrammatic representation of the remote tracking device used by the remote operator in FIG. 1.

FIG. 4 is a diagrammatic representation of the tracking device 59 of FIG. 1, showing again the maimer in which the transceiver 60 receives the tracking data signal 74 from the beacon 72 (FIG. 1) and transmits a modulated tracking data signal 74' to the drilling machine 12 to report tracking information as described above. An input device such as a keypad 78 is provided for the remote operator's 22 use in initiating the remote enable signal 62 which can be transmitted separately, as shown, or as part of the modulated tracking data signal 74'.

Figure 5:
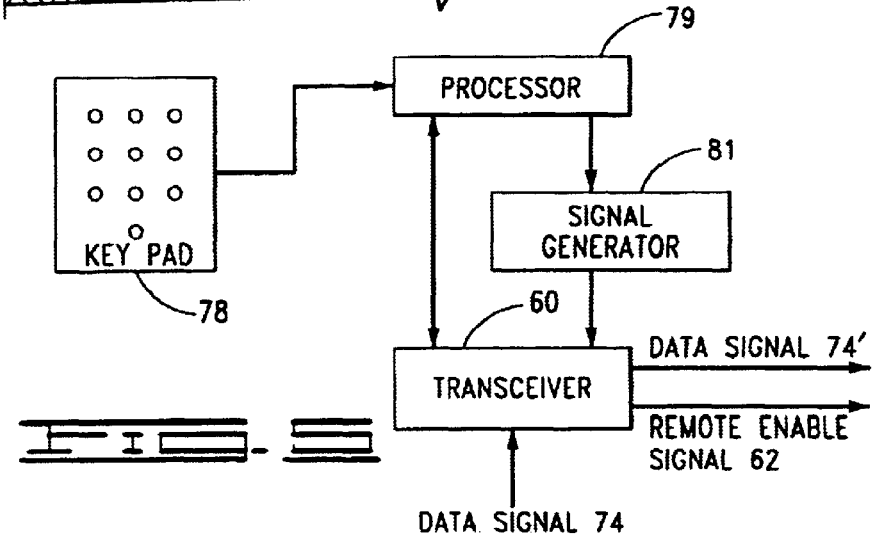
FIG. 5 is a block diagram of a portion of the control system for the remote tracking device of FIG. 4.
Figure 5:
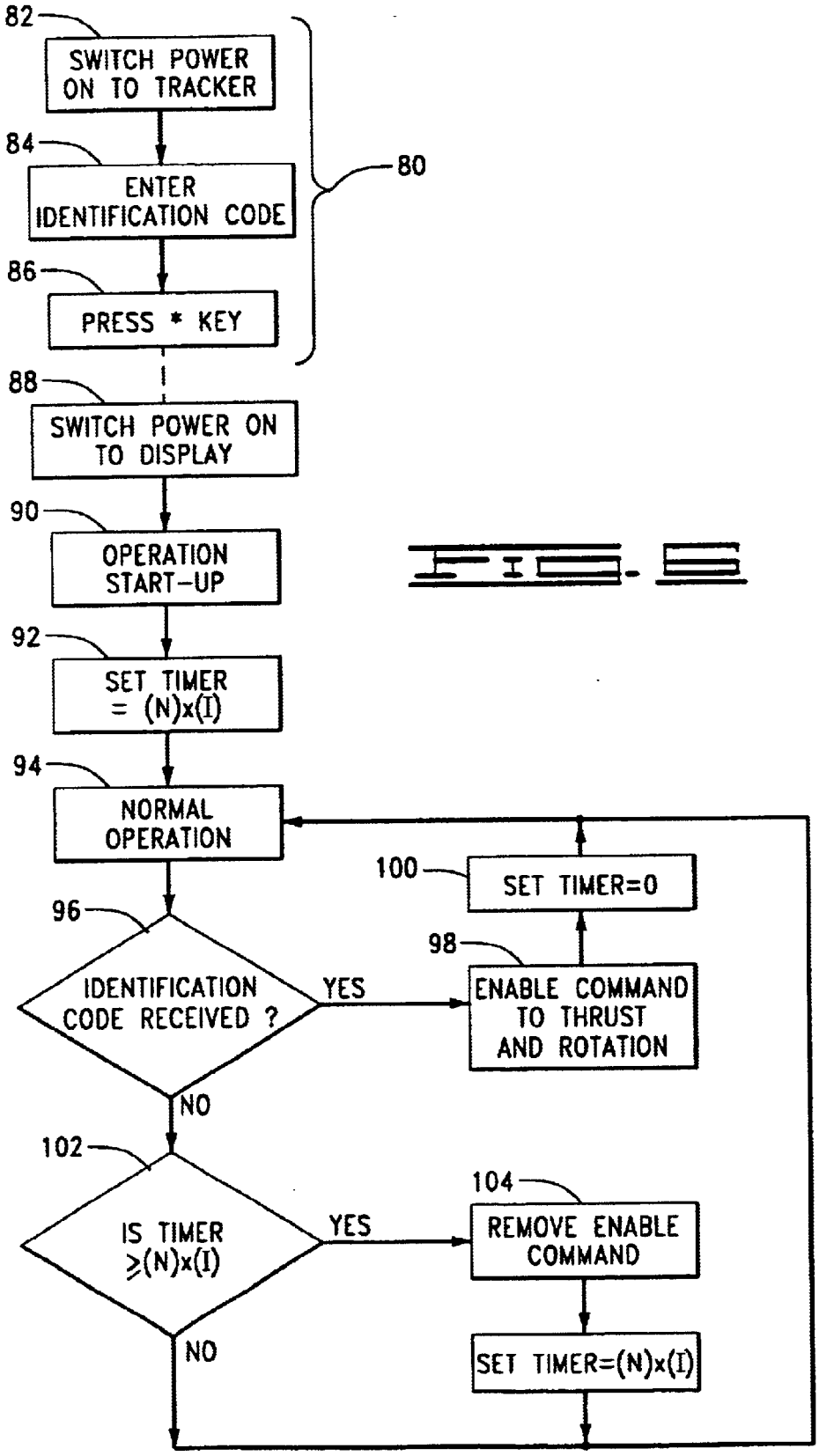

More particularly, FIG. 5 is a block diagram of a portion of the control system for the tracking device 59. The keypad 78 provides input to a processor 79 which energizes a signal generator 81 to send an enable signal having preselected characteristics to the transceiver 60 which, in turn, transmits a remote enable signal 62 to enable the drilling machine 12. The transceiver 60 furthermore receives the tracking data signal 74 which is modulated by the processor 79 and then likewise transmitted to the drilling machine 12. As stated previously, even though FIG. 5 indicates that the signals 62 and 74' are transmitted separately, the signals can alternatively be combined in a conventional manner and transmitted as a single signal.

Upon detecting the remote enable signal 62, the control system 13 sends a command to enable the drive assembly 28. For illustration purposes, the following describes enabling the drive assembly 28 in terms of enabling the thrust power unit 40 and/or the rotation power unit 46 (FIG. 2). The enable command can be executed in a conventional manner, such as by activation of an electrical or hydraulic circuit interlock that is responsive to the control system 13. As described below, the enable command remains in effect until the remote enable signal 62 is no longer detected for a preselected interval.

The drilling machine operator 19 has operable control of the thrust and rotation power units 40, 46 only when the remote enable signal 62, which is under control of the remote operator 22 is detected by the control system 13. Preferably, in order to minimize nuisance shut downs, a selected interval must pass with no detection of the remote enable signal 62 before the disabled mode, is invoked. That is, a selected interval, similar to a grace period, must elapse, during which no remote enable signal 62 is detected, before the drive system is disabled. If the remote enable signal 62 is received within that interval, the disabled mode is not invoked.

For example, in one embodiment the transceiver 60 emits a substantially regular intermittent remote-enabling signal 62 comprising a sequential signal pulse series with a preselected interval between consecutive pulses. The control system 13 detects a remote enable signal pulse and responsively enables the power units 40 and 46 respectively. Thereafter, the control system 13 seeks to detect a remote enable signal pulse during the next interval. The control system 13 disables the power units 40 and 46 only after a remote enable signal pulse is not detected in each of a selected number of consecutive intervals. For example, if the selected interval is eight seconds, and two consecutive intervals without a remote enable signal pulse is preselected as a condition precedent to disabling the power units 40 and 46, then detection of the remote enable signal 62 can be interrupted for up to sixteen seconds before a disable condition is invoked.

In an alternative embodiment, the transceiver 60 can emit a substantially continuous remote enable signal 62' and the control system 13 invokes a disabled condition only after the continuous remote enable signal 62' is not detected for a preselected interval so that a momentary loss of the continuous remote enable signal will not result in a disabled condition.

FIG. 6 is a flow chart diagram of a portion of the control system 13 providing a remote enable control routine of the present invention. The remote operator 22 initiates the remote enable control routine by performing a start-up sequence 80. First, power is switched on to the tracking device 59 as indicated by step 82. Next, an identification code is entered into the tracking device 59 as indicated by step 84. Then, an additional keypad entry is performed by the remote operator 22. For example, step 86 illustrates that an asterisk key ("*") on the keypad 78 (FIG. 4) must be pressed. This completes the remote operator's 22 start-up sequence 80 of the tracking device 59, and will result in commencement of the remote enable signal 62 from the transceiver 60.

It will be noted in FIG. 6 that the steps of the start-up sequence 80 performed by the remote operator 22 are diagrammatically connected by a broken line to the steps performed by the drilling machine operator 19 and the control system 13 of the drilling machine 12, which are discussed below. This is because the two groupings of steps are operably parallel, that is, either group can be performed first, or both can be performed simultaneously.

The drilling machine operator 19 switches on power to the display 77 at step 88, which invokes a number of initializations in order to achieve an operation start-up mode at 90. The control system 13 then sets a timer to a value determined by the preselected interval (I) multiplied by the preselected number of intervals (N) that can elapse without a remote enable signal 62 before a disable condition will be invoked. For example, the timer would be set to sixteen seconds in step 92 for the case of two intervals of eight seconds each. Completion of these steps provides a normal operation mode at block 94.

The control system 13 then determines whether the remote enable signal 62 containing the correct identification code has been received in step 96. If in step 96, the remote enable signal 62 with the correct identification code is received, then in step 98 the control system 13 invokes an enable command to the thrust power unit 40 and the rotation power unit 46 (FIG. 2), to maintain normal operation of the drilling machine 12. That is, the drilling machine operator 19 has control of the power units 40, 46. The timer is then set to zero in block 100. In step 96, if the remote enable signal 62 is found not to include the correct identification code, then the control system 13 in step 102 determines whether the elapsed time is equal to or greater than the value (N×I) selected in step 92. If, the elapsed time is not equal to or greater than the value (N×I) selected in step 102, then the normal operation mode is continued. However, if in step 102 it is determined that the elapsed time is equal to or greater than the value (N×I) selected in step 92, the enable command is removed at block 104 to disable the thrust power unit 40 and the rotation power unit 46 (FIG. 2). The control system 13 maintains the disabled condition until a remote enable signal 62 with the correct identification code is once again received.

It will be noted that the discussion above has described both the thrust and rotation actions being disabled by the remote control of the operator. Alternatively, one or the other could be disabled in an equivalent alternative of the present invention. Furthermore, the above description is illustrative of the scope of the present invention and not limiting therefore to only the thrust and/or rotation actions, but any actions that would advantageously be enabled/disabled remotely by the remote operator 22. Several measures can be taken to ensure that a detected remote enable signal has been affirmatively sent by the remote operator 22, and that a disable condition remains in effect until the remote operator 22 affirmatively establishes the enabled condition. Following is a further description of some safeguards previously described, as well as an illustrative description of some other types of safeguards that can be used in the present invention.

First, measures can be taken to ensure that the remote enable signal 62 is not sent inadvertently. For example, the identification code described previously can be transmitted within the remote enable signal 62 to link a given transceiver 60 only with the intended drilling machine 12. This prevents cross-talking of a transceiver 60 with other drilling machines 12 that are within transmission range. The coded signal can be created by the remote operator 22 entering an identification code into the tracking device 59 by way of an input device, such as the numeric keypad 78 shown in FIG. 5. The identification code, for example, may be any predetermined four digit number from 0000 to 9999. The predetermined identification code is programmed permanently into the tracking device 59. However, the remote operator 22 can adjust/set this number to match the particular drilling machine 12 with which the tracking device 59 is being used. The identification code is then transmitted within the remote enable signal 62, such as by frequency shift keying methodology, as will be explained later. The control system 13 of the drilling machine 12 matches the identification code received with a code stored in memory as a condition precedent to commencing or continuing an enable command. Alternatively, the transceiver 60 could transmit a hard-wired code and the control system 13 of the drilling machine 12 could require the entry of a matching identification code. Of course, both transceiver 60 and control system 13 could have hard-wired or selectable identification codes as well.

Another measure can be taken to require the remote operator 22 to perform one or more additional keypad entries following entry of the identification code, as described previously. This reduces the possibility that an operator might inadvertently enable the drilling machine 12 immediately after entering the identification code. An additional keypad entry might be clearly identified, such as by a keypad button labeled "START." Alternatively, the additional keypad entry might be of an obscured identity, such as in the start up sequence 80 of FIG. 6 by requiring the "*" keypad button be pressed after the identification code. This latter approach better ensures that a trained and cognizant operator is manning the tracking device 59 emitting the remote enable signal 62.

Similarly, a number of measures can be taken to ensure that a disable condition remains in effect after the remote operator 22 invokes it, and for as long as the remote operator 22 intends. For example, limiting the drilling machine operator's 19 use of any override mechanism can be provided. A manual override of the remote enable signal 62 is advantageous for use during times when the remote operator 22 does not need to monitor the drill string 14, such as when drilling in wide-open spaces. But affirmative steps should be taken to prevent the drilling machine operator 19 from being able to unilaterally override a disabled condition once invoked by the remote operator 22. One way of doing so is by controlling the manual override with a keyed switch, thus requiring a removable key to turn the override on. By turning the override off and taking possession of the key, the remote operator 22 can ensure that an inadvertent override does not occur. When the drilling machine 12 can be safely operated again without the need for the remote enable signal 62, the remote operator 22 returns the key to the drilling machine operator 19 to return control of the override.

Another measure involves giving the remote operator 22 an affirmative indication when the disabled condition is in effect. A light 106 (FIG. 1), for example, can be provided on the drilling machine 12 to provide a visible indicator of the disabled condition. An audible alarm can also be provided in order to provide a non-visual affirmative feedback. It will be understood from the above that in FIG. 1 the remote operator 22 has invoked the disabled mode. That is, the transceiver 60 is not transmitting the remote enable signal 62, so the drilling machine operator cannot advance or rotate the drill string 14.

Figure 7:
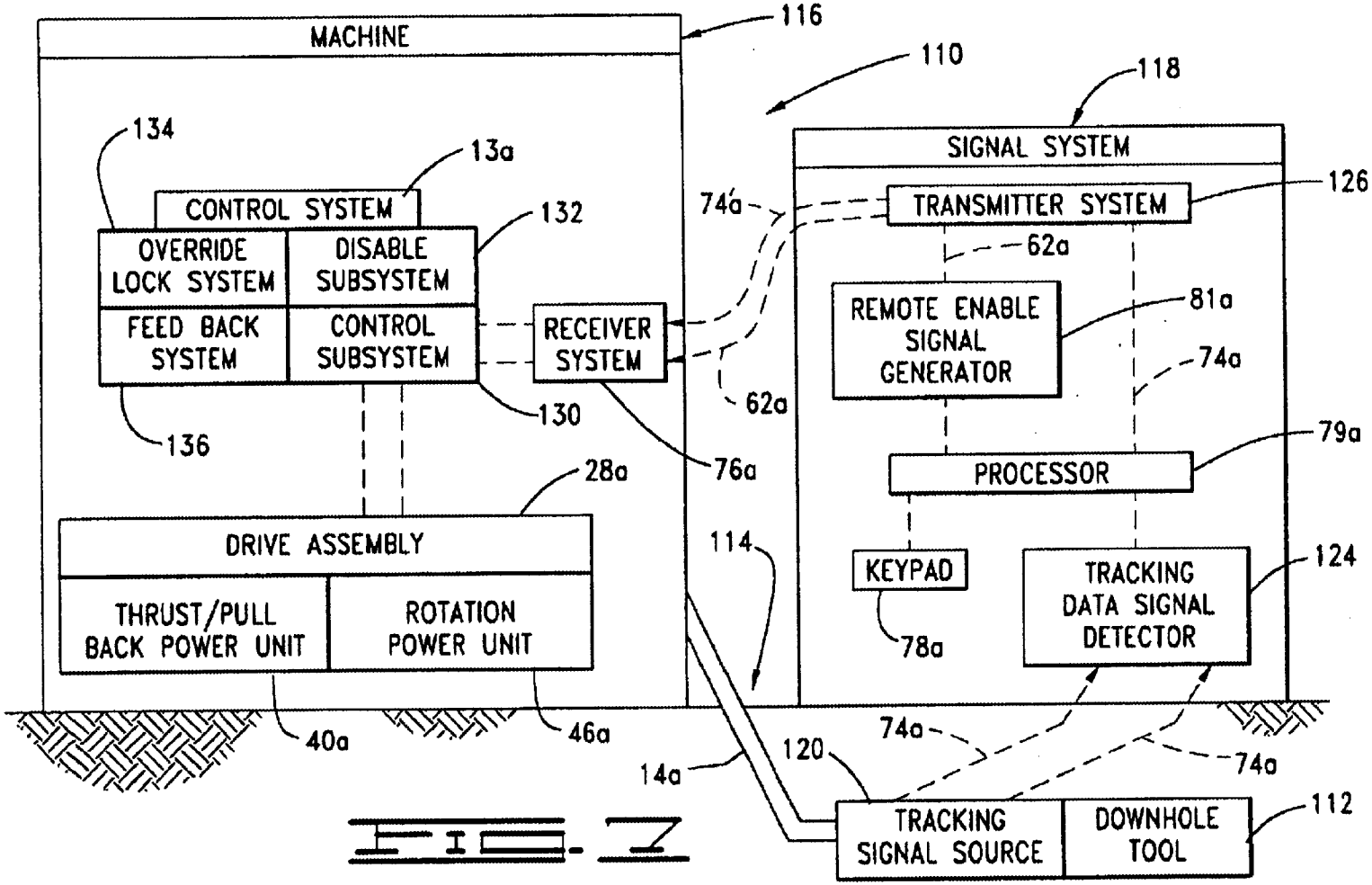
FIG. 7 is a block diagram of a remotely controlled system constructed in accordance with the present invention.

Turning now to FIG. 7, shown therein is a system 110 that is constructed in accordance with the present invention. The system 110 is adapted for moving a downhole tool 112 along a subsurface path from an origination point 114 at the surface of the ground.

Preferably, the system 110 comprises a machine 116, a signal system 118, and a tracking signal source 120. The machine 116 may include a control system 13*a*. The control system 13*a*, in response to input commands and by way of conventional control members controls components of the machine 116. For example, the control system 13*a* is adapted to control the movement of the downhole tool 112 along the subsurface path from the origination point 114 through a drive assembly 28*a*.

The drive assembly 28*a* imparts driving outputs, such as rotation and thrust outputs to the downhole tool 112 during drilling and backreaming operations. Even though thrust and rotation outputs are discussed herein, it is to be understood that the present invention can be readily adapted to impart other outputs to the downhole tool 112 as described herein. Preferably, the drive assembly 28*a* comprises power units such as a thrust power unit 40*a*, a rotation power unit 46*a* and other power units that can be selectively activated to impart the desired driving output to the downhole tool 112 through a drill string 14*a* formed by a plurality of interconnected pipe sections. The thrust power unit 40*a* and the rotation power unit 46*a* may be any source of power capable of providing the thrust and rotation outputs respectively to the downhole tool 112 as discussed previously.

Depending on the types of driving output applied by the drive assembly 28*a*, various components of downhole tool motion may be actuated as will be described herein. As stated earlier, the drive assembly 28*a* is operable between an enabled mode and a disabled mode. In the preferred embodiment, in the enabled mode, the drive assembly 28*a* can actuate a plurality of kinematic components of downhole tool motion. The kinematic components, for example, that can be actuated by the drive assembly 28*a*, may include actuating thrust only, rotation only, thrust and rotation combined or any other desired components of downhole tool motion either singly or in combination. In the disabled mode, the drive assembly 28*a* cannot actuate any kinematic component of downhole tool motion.

Generally, the drive assembly 28*a* is enabled and disabled by the control system 13*a* located proximate to the origination point 114. However, as stated earlier, there are many circumstances in which it is preferable to enable and disable the drive assembly 28*a* from a location remote from the origination point 114. In the preferred embodiment as illustrated in FIG. 7, the drive assembly 28*a* functions are controlled remotely by the signal system 118. That is, the signal system 118 can enable and disable the drive assembly 28*a* directly.

Figure 8:
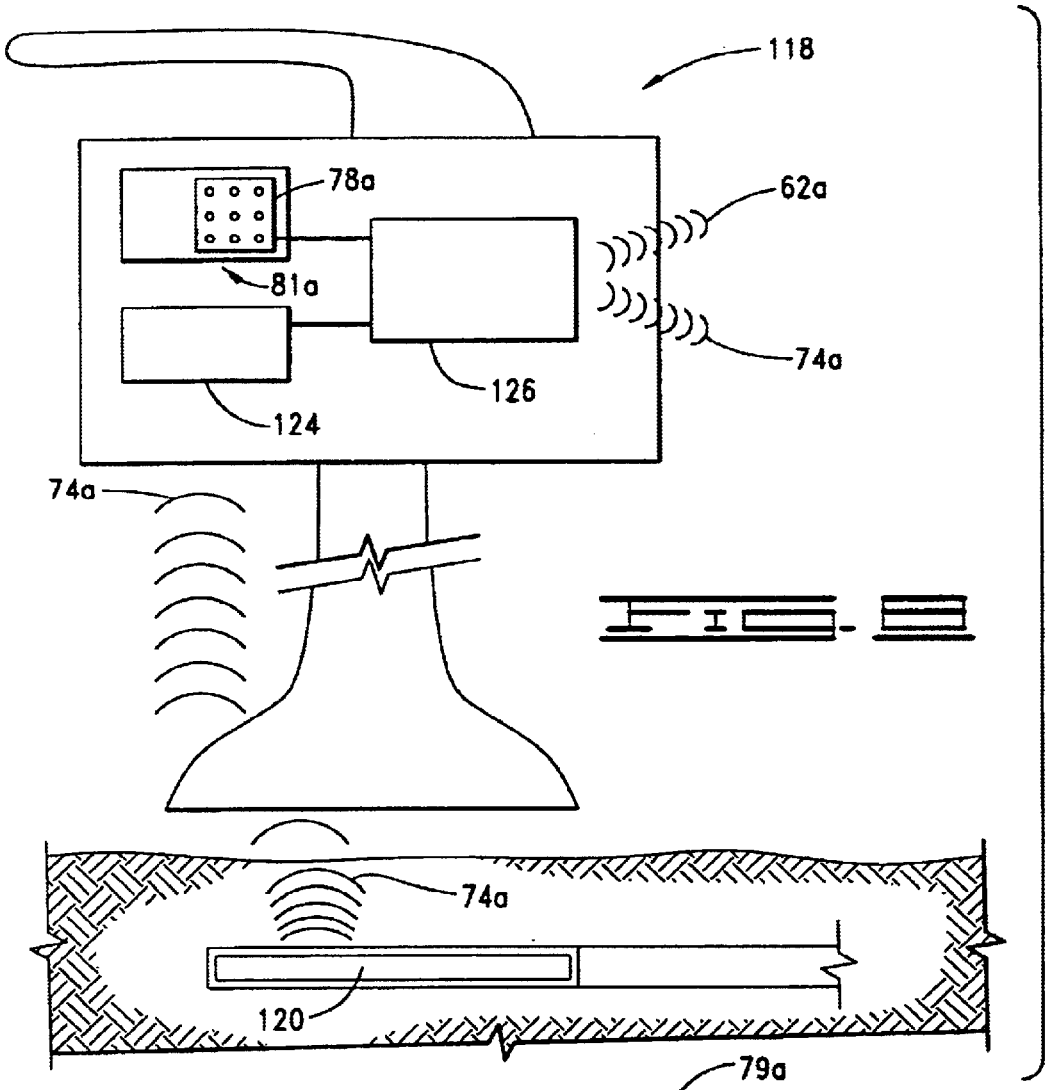
FIG. 8 is a diagrammatic representation of the remote signal system constructed in accordance with the present invention.
Figure 9:
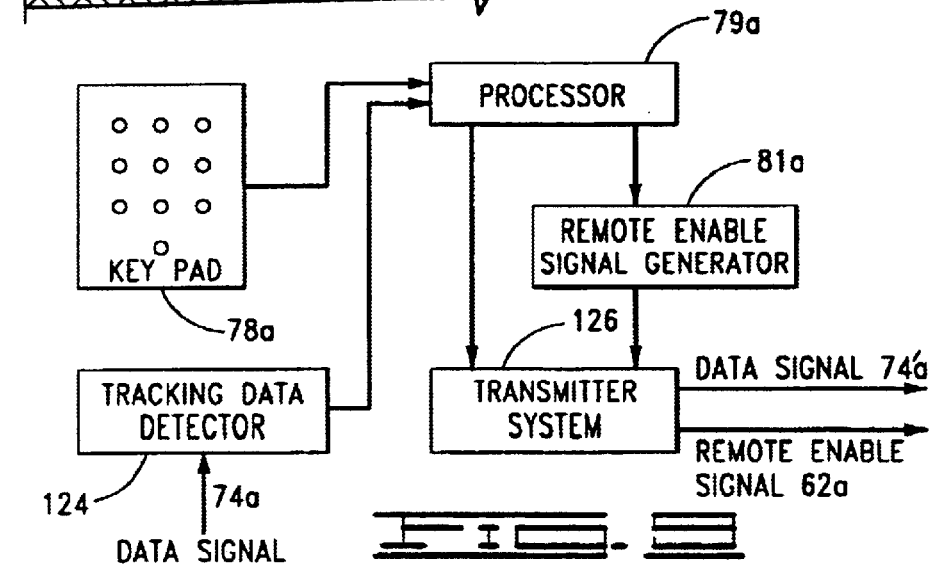
FIG. 9 is a block diagram of a portion of the remote system of FIG. 8.

Preferably, as illustrated in FIGS. 8 and 9, the signal system 118 is an input device for selectivity sending a remote enable signal 62*a* to the control system 13*a* to enable the drive assembly 28*a*. Absence of the remote enable signal 62*a* under preselected conditions disables the drive assembly 28*a*. In the preferred embodiment the signal system 118 comprises a remote enable signal generator 81*a*, a tracking data detector 124 and a transmitter system 126. The remote enable signal generator 81*a*, is adapted to generate the remote enable signal 62*a*. The remote enable signal generator 81*a* may include any input device such as a keypad 78*a* (FIG. 5) that is provided to input a component of the remote enable signal 62*a*. The keypad 78*a* provides input to a processor 79*a* (FIG. 5) that energizes the remote enable signal generator 81*a* to send a remote enable signal 62*a* having preselected characteristics to the transmitter system 126. The transmitter system 126, will in turn relay the remote enable signal 62*a* to the control system 13*a* to enable the drive assembly 28*a*.

With continued reference to FIGS. 8 and 9, in addition to relaying the remote enable signal 62*a*, the signal system 118 can be adapted to relay data signals received from the tracking signal source 120 (FIG. 7) disposed adjacent to the downhole tool 112. The tracking signal source 120 can be any source capable of generating and transmitting a tracking data signal 74*a* carrying information regarding the downhole tool or the soil conditions to a receiver above ground such as a tracking data detector 124. Preferably, the tracking data detector 124 receives the tracking data signal 74*a* and transmits it to the processor 79*a* wherein the tracking data signal is modulated by the processor and relayed to the control system 13*a* by the transmitter system 126.

The remote enable signal generator 81*a* and the tracking data detector 124 may be two separate devices. However, in the present embodiment as illustrated in FIG. 7, the remote enable signal generator 81*a* and the tracking data detector 124 are integral parts of the same device, the signal system 118. Preferably, the signal system 118 is a portable device. For example, the signal system 118 may be a device on wheels that can be easily manipulated by the remote operator 22*a* (FIG. 1) or can be carried by the remote operator (FIG. 3). When configured as two separate devices, the signal generator 81*a* can be worn by the remote operator, such as at the waist of the operator by way of a belt-clip or may be hand-held. Additionally, as stated earlier, the remote enable signal 62*a* and the tracking data signal 74*a* may be relayed to the control system 13*a* as two separate signals or as a single signal by the transmitter system 126.

Turning now to the control system 13*a* as depicted in FIG. 7, preferably, the control system includes a receiver system 76*a* adapted to receive the remote enable signal 62*a* and the tracking data signal 74'*a*. Alternatively, if no tracking data signal 74'*a* is desired, the receiver system 76*a* will receive only the remote enable signal 62*a*. Upon detecting the remote enable signal 62*a*, the control system 13*a* through a control subsystem 130 sends a command to enable the drive assembly 28*a*. It may be noted that the control subsystem 130 can control the drive assembly 28*a* to selectively actuate any operating and steering component of downhole tool motion either separately or in any desired combination as stated earlier. However, the control subsystem 130 is only able to enable the drive assembly 28*a* so long as the control system 13*a* receives the remote enable signal 62*a*.

For illustration purposes as seen in FIG. 7, the following describes enabling the drive assembly 28*a* in terms of enabling the thrust power unit 40*a* and/or the rotation power unit 46*a*. The enable command can be executed in a conventional manner, such as by activation of an electrical or hydraulic circuit interlock that is responsive to the control subsystem 130 and will remain in effect until the remote enable signal 62*a* is no longer detected for a preselected interval. The remote enable signal 62*a* may be characterized by a substantially continuous wave form or an intermittent wave form in the alternative as stated earlier. Preferably, the remote enable signal 62*a* is characterized by a fixed and predetermined pulse interval wherein the pulse frequency is set at the maximum frequency that does not interfere with the relaying of the tracking data. Alternatively, if tracking data information is not required, the remote enable signal 62*a* is characterized by a fixed and predetermined pulse interval wherein the pulse frequency may be set at any desired frequency.

Preferably, the remote enable signal 62*a* must be received within the fixed and predetermined interval by the control system 13*a* so as to operate the drive assembly 28*a* in the enabled mode. However, if the remote enable signal 62*a* is not received within the fixed and predetermined interval, the control system 13*a*, the drive assembly 28*a* will be disabled. That is, the fixed and predetermined pulse interval is a mechanism to ensure that a selected interval must pass during which no remote enable signal is detected before the drive assembly 28*a* is disabled as described herein.

In the preferred embodiment, as illustrated in FIG. 7, the control system 13*a* includes a remote disable system 132 that is responsive to the receiver system 76*a*. That is, the remote disable subsystem 132 will place the drive assembly 28*a* in its disabled mode in response to a designated interruption in the remote enable signal 62*a*. Once disabled, the drive assembly is unable to actuate any kinematic component of the downhole tool motion. However, the disabled mode is only invoked in the absence of the reception of the remote enable signal 62*a* by the control system 13*a*.

Preferably, the signal system 118 and the control system 13*a* are communicatively linked to each other by a unique preselected identification code as discussed earlier. That is, the control system 13*a* will respond to the signal system 118 that is identifiable only by the preselected identification code. The identification code for example, may be any predetermined four digit number from 0000 to 9999. However, any desired number of digits in any desired preselected combination may be used. Once determined, the preselected identification code is programmed into the signal system 118. However, the identification code may be reconfigured and reset to match the particular machine 116 such as the drilling machine 12 with which the signal system 118 is being used. Preferably, the identification code is transmitted within the remote enable signal 62*a*, such as by frequency shift keying methodology. For example, the identification code may be sent using a radio frequency signal (usually at 469.5 MHz by Frequency Shiftkeying Modulation) encoded into a packet of four (4) bytes. The first byte of the packet signifies what kind of message follows. The next two bytes are the identification code in the LSB-MSB format, and the last byte is a verification code for the entire message. The control system 13*a* preferably, confirms receipt of the correct identification code as a condition precedent to commencing or continuing the enable command. For example, the control system 13*a* matches the identification code received with the same code stored in memory of the control system, or may require entry of the same code by an operator of the machine 116, or yet may require the control system 13*a* to transmit a confirmation code to the signal system as a condition precedent to permitting control of the drive assembly 28*a* by the signal system 118.

If the remote enable signal 62*a* carrying the correct identification code is received and confirmed by the control system 13*a*, the signal system 118 then has direct control of the drive assembly 28*a*. However, generally, the control system 13*a* is equipped with an override mechanism that allows the control system 13*a* to regain control of the drive assembly 28*a* from the signal system 118. In the preferred embodiment, as illustrated in FIG. 7, the machine 116 comprises an override lock system 134. The override lock system 134 may be any mechanism, manual or automatic, either at the control system 13*a* or the signal system 118 that can control the override mechanism at the control system. In the preferred embodiment, the override mechanism is located at the control system 13*a* and is manual. That is, the override lock system 134 is a keyed switch, thus requiring an operator to insert a removable key into a keypad at the control system 13*a* to turn the override on. If the override is on, the control system 13*a* can be controlled independent of the signal system 118. However, if the override is turned off and the key removed by the remote operator 22*a*, then the signal system 118 independently controls the drive assembly 28*a*. Thus activation of the override lock system 134 provides exclusive access of the control system 13*a* to the signal system 118.

As illustrated in FIG. 7, the preferred embodiment may also include a remote feedback system 136 at the control system 13*a* to signal the mode of the drive assembly 28*a* to the signal system 118. The feedback system may be any visual, audible, or tactile mechanism to communicate the mode of the drive assembly 28*a* to the signal system 118 as stated earlier. For example, a light 106 (FIG. 1) in different colors, may be used, such as one color green to signal an enable mode at the drive assembly 28*a,* and another color red to signal a disable mode at the drive assembly. Preferably, the light is mounted high and towards the front of the control system 13*a* to allow quick visual reference to verify the mode of the drive assembly as seen in FIG. 1 However, any other location of the light 106 that allows quick and easy visual reference to the signal system 118 may be used. Alternatively, the remote feedback system 136 may be adapted to provide feedback to the signal system 118 only when the drive assembly 28*a* is in the disabled mode. For example, a light or an audible alarm or vibratory pulses may be emitted to indicate when the drive assembly 28*a* has been disabled or when the control system 13*a* has lost contact with the signal system for a time period not to exceed the preselected pulse internal as discussed earlier.

It is clear that the present invention is well adapted to attain the ends and advantages mentioned as well as those inherent therein. While a presently preferred embodiment of the invention has been described for purposes of the disclosure, it will be understood that numerous changes may be made which will readily suggest themselves to those skilled in the art and which are encompassed within the spirit of the invention disclosed and as defined in the appended claims.

What is claimed is:

1. A system for moving a downhole tool along a subsurface path having an origination point, the system comprising:

a drive assembly adapted to move the downhole tool, the drive assembly having an enabled mode, in which the drive assembly can actuate at least one kinematic component of downhole tool motion; and a disabled mode, in which the drive assembly cannot actuate the same at least one kinematic component of downhole tool motion;

a tracking signal source disposed adjacent the downhole tool and adapted to generate and transmit a tracking data signal;

a signal system, positionable at a remote location from the origination point, comprising:

a tracking data detector adapted to detect the tracking data signal;

a remote enable signal generator adapted to generate a remote enable signal; and a transmitter system adapted to relay the tracking data signal and the remote enable signal; and a control system comprising:

a receiver system adapted to receive the remote enable and tracking data signal;

a control subsystem, adapted to control the drive assembly only while that assembly is in its enabled mode; and a remote disable subsystem, responsive to the receiver system, which places the drive assembly in its disabled mode in response to a designated interruption in reception of the remote enable signal.

2. The system of claim 1 wherein the control system is positionable near the origination point.

3. The system of claim 2 wherein the tracking data detector and the remote enable signal generator of the signal system are contained in a single unit.

4. The system of claim 3 wherein the transmitter system of the signal system comprises a wireless transmitter.

5. The system of claim 4 wherein the tracking data signal and the remote enable signal are relayed as one signal.

6. The system of claim 4 wherein the tracking data signal and the remote enable signal are relayed as separate signals.

7. The system of claim 1 wherein the remote enable signal generator of the signal system comprises a keypad which can input a component of the remote enable signal.

8. The system of claim 1 wherein the remote enable signal is characterized by an intermittent waveform.

9. The system of claim 8 wherein the remote enable signal is characterized by a fixed and predetermined pulse interval.

10. The system of claim 9 wherein the fixed and predetermined pulse interval comprises a maximum pulse frequency that does not interfere with the relaying of the tracking data.

11. The system of claim 1 wherein the remote enable signal is characterized by a substantially continuous waveform.

12. The system of claim 1 wherein the control system is responsive only to a remote enable signal carrying a preselected identification code.

13. The system of claim 12 wherein the signal system includes a key system which must be actuated before the transmitter relays the remote enable signal carrying the preselected identification code.

14. The system of claim 12 wherein the control system further comprises an override lock system adapted to disable the remote disable system.

15. The system of claim 14 wherein the override lock system is manually operable by a system user and wherein activation of the override lock system provides exclusive access of the control system to the signal system.

16. The system of claim 15 wherein the manual override system comprises an override key which can be rendered inaccessible to personnel at the origination point.

17. The system of claim 1 wherein the same at least one component of the downhole tool motion is thrust.

18. The system of claim 1 wherein the same at least one component of the downhole tool motion is rotation.

19. The system of claim 1 wherein the same at least one component of the downhole tool motion is thrust and rotation.

20. The system of claim 1 wherein signal system can be carried by a human user.

21. A signal system for remotely controlling an action of a machine having a drive assembly operable by a control system between an enabled mode and a disabled mode, wherein the drive assembly is adapted to move a downhole tool operably connected to a tracking data signal source emitting a tracking data signal as the downhole tool is moved along a subsurface path from an origination point, the signal system comprising:

a tracking data detector adapted to detect the tracking data signal;

a remote enable signal generator adapted to generate and transmit a remote enable signal; and a transmitter system adapted to relay the remote enable signal and the tracking data signal, wherein the signal system is adapted to control the drive assembly only when it relays the remote enable signal to the control system.

22. The signal system of claim 21 wherein the control system is adapted to receive the tracking data signal and the remote enable signal and wherein the control system is adapted to enable the drive assembly only when the control system receives the remote enable signal.

23. The signal system of claim 21 wherein the drive assembly in the enabled mode can actuate at least one kinematic component of the downhole tool motion, and wherein in the disabled mode the drive assembly cannot actuate the same at least one kinematic component of the downhole tool motion.

24. The system of claim 23 wherein the same at least one component of the downhole tool motion is thrust.

25. The system of claim 23 wherein the same at least one component of the downhole tool motion is rotation.

26. The system of claim 23 wherein the same at least one component of the downhole tool motion is thrust and rotation.

27. The system of claim 21 wherein the control system is positionable near the origination point.

28. The system of claim 21 wherein the remote enable signal generator is positionable at a location remote from the origination point.

29. The system of claim 28 wherein the tracking data detector and the remote enable signal generator of the signal system are contained in a single unit.

30. The system of claim 29 wherein the transmitter system of the signal system comprises a wireless transmitter.

31. The system of claim 30 wherein the tracking data signal and the remote enable signal are relayed as one signal.

32. The system of claim 30 wherein the tracking data signal and the remote enable signal are relayed as separate signals.

33. The signal system of claim 27 wherein the control system comprises:

a receiver system adapted to receive the remote enable and tracking data signals;

a control subsystem adapted to control the drive assembly only while that assembly is in its enabled mode; and a remote disable subsystem responsive to the receiver system which places the drive assembly in its disabled mode in response to a designated interruption in reception of the remote enable signal.

34. A control system for a drive assembly of a machine adapted to control movement of a downhole tool along a subsurface path from an origination point in response to a remote enable signal received from a signal system at a location remote from the origination point, the control system comprising:

a receiver system adapted to receive the remote enable signal;

a control subsystem adapted to control the drive assembly wherein the drive assembly is adapted to having:

an enable mode in which the drive assembly can actuate at least one kinematic component of the downhole tool motion;

a disabled mode in which the drive assembly cannot actuate the same at least one kinematic component of the downhole tool motion; and wherein the control subsystem can only control the drive assembly while that system is in its enabled mode; and a remote disable subsystem, responsive to the receiver system which places the drive assembly in its disabled mode in response to a designated interruption in reception of the remote enable signal.

35. The system of claim 34 wherein the control system is positionable near the origination point.

36. The system of claim 34 wherein the same at least one component of the downhole tool motion is thrust.

37. The system of claim 34 wherein the same at least one component of the downhole tool motion is rotation.

38. The system of claim 34 wherein the same at least one component of the downhole tool motion is thrust and rotation.

39. A system comprising:

a downhole tool;

a drive assembly adapted to move the downhole tool along a subsurface path from an origination point, the drive assembly having an enabled mode, in which the drive assembly can actuate at least one kinematic component of the downhole tool motion, and a disabled mode, in which the drive assembly cannot actuate the same at least one kinematic component of the downhole tool motion;

a signal system, positionable at a remote location from the origination point, comprising:

a remote enable signal generator adapted to generate a remote enable signal; and a transmitter system adapted to relay the remote enable signal; and a control system comprising:

a receiver system adapted to receive the remote enable signal;

a control subsystem, adapted to control the drive assembly only while that system is in its enabled mode;

a remote disable subsystem, responsive to the receiver system, which places the drive assembly in its disabled mode in response to a designated interruption in reception of the remote enable signal;

an override key which can be rendered inaccessible to personnel at the path origination site; and an override lock system adapted to disable the remote disable system in response to actuation by the override key.

40. The system of claim 39 wherein the control system is positionable near the origination point.

41. The system of claim 40 further comprising a tracking signal source disposed adjacent the downhole tool and adapted to generate and transmit a tracking data signal.

42. The system of claim 41 wherein the signal system further comprises a tracking data detector adapted to detect the tracking data signal.

43. The system of claim 42 wherein the tracking data detector and the remote enable signal generator of the signal system are contained in a single unit.

44. The system of claim 43 wherein the transmitter system of the signal system comprises a wireless transmitter.

45. The system of claim 44 wherein the tracking data signal and the remote enable signal are relayed as one signal.

46. The system of claim 39 wherein the remote enable signal is characterized by an intermittent waveform.

47. The system of claim 46 wherein the remote enable signal is characterized by a fixed and predetermined pulse interval.

48. The system of claim 47 wherein the fixed and predetermined pulse interval comprises a maximum pulse frequency that does not interfere with the relaying of the tracking data.

49. The system of claim 39 wherein the remote enable signal is characterized by a substantially continuous waveform.

50. The system of claim 39 wherein the control system is responsive only to a remote enable signal carrying a preselected identification code.

51. The system of claim 50 wherein the signal system includes a key system which must be actuated before the transmitter relays the remote enable signal carrying the preselected identification code.

52. A system for moving a downhole tool along a subsurface path having an origination point, the system comprising:

a drive assembly adapted to move the downhole tool, the drive assembly having:

an enabled mode, in which the drive assembly can actuate at least one kinematic component of the downhole tool motion; and a disabled mode, in which the drive assembly cannot actuate the same at least one kinematic component of the downhole tool motion;

a signal system, positionable at a remote location from the origination point, comprising:

a remote enable signal generator adapted to generate a remote enable signal including an identification code selectable by a user of the system; and a transmitter system adapted to relay the remote enable signal along with the identification code; and a control system comprising:

a receiver system adapted to receive the remote enable signal, and distinguish that signal from those which lack the user selectable identification code and signal;

a control subsystem, adapted to control the drive assembly only while that assembly is in its enabled mode; and a remote disable subsystem, responsive to the receiver system, which places the drive assembly in its disabled mode in response to a designated interruption in reception of the remote enable signal.

53. The system of claim 52 wherein the control system is positionable near the origination point.

54. The system of claim 52 wherein the remote enable signal is characterized by an intermittent waveform.

55. The system of claim 54 wherein the remote enable signal is characterized by a fixed and predetermined pulse interval.

56. The system of claim 55 wherein the fixed and predetermined pulse interval comprises a maximum pulse frequency that does not interfere with the relaying of the tracking data.

57. The system of claim 52 wherein the remote enable signal is characterized by a substantially continuous waveform.

58. The system of claim 52 wherein the signal system includes a key system which must be actuated before the transmitter relays the remote enable signal carrying the preselected identification code.

59. The system of claim 53 wherein the control system further comprises an override lock system adapted to disable the remote disable system.

60. The system of claim 59 wherein the override lock system is manually operable by a system user and wherein activation of the override lock system provides exclusive access of the control system to the signal system.

61. The system of claim 60 wherein the manual override system comprises an override key which can be rendered inaccessible to personnel at the origination point.

62. The system of claim 52 wherein the same at least one component of the downhole tool motion is thrust.

63. The system of claim 52 wherein the same at least one component of the downhole tool motion is rotation.

64. The system of claim 52 wherein the same at least one component of the downhole tool motion is thrust and rotation.

65. The system of claim 52 wherein signal system can be carried by a human user.

66. A system comprising:

a downhole tool;

a drive assembly adapted to move the downhole tool, the drive assembly having;

an enabled mode, in which the drive assembly can actuate at least one kinematic component of the downhole tool motion; and a disabled mode, in which the drive assembly cannot actuate the same at least one kinematic component of the downhole tool motion;

a signal system, positionable at a remote location spaced from the origination point, comprising:

a remote enable signal generator adapted to generate a remote enable signal; and a transmitter system adapted to relay the remote enable signal; and a control system comprising:

a receiver system adapted to receive the remote enable signal;

a control subsystem, adapted to control the drive assembly only while that assembly is in its enabled mode; and a remote disable subsystem, responsive to the receiver system, which places the drive assembly in its disabled mode in response to a designated interruption in reception of the remote enable signal; and a remote feedback system adapted to signal the mode of the drive assembly to the remote location.

67. The system of claim 66 wherein the remote feedback system is independent of the signal system.

68. The system of claim 67 wherein the remote feedback system emits a visual signal that can be visually perceived by a user of the remote signal system.

69. The system of claim 67 wherein the remote feedback system emits an audible signal that can be heard by a user of the remote signal system.

70. The system of claim 66 wherein the control system is positionable near the origination point.

71. The system of claim 66 wherein the same at least one component of the downhole tool motion is thrust.

72. The system of claim 66 wherein the same at least one component of the downhole tool motion is rotation.

73. The system of claim 66 wherein the same at least one component of the downhole tool motion is thrust and rotation.

74. A system for moving a downhole tool along a subsurface path having an origination point, the system comprising;

a drive assembly adapted TO move the downhole tool, the drive assembly having an enabled mode, in which the drive assembly can actuate at least one kinematic component of downhole tool motion; and a disabled mode, in which the drive assembly cannot actuate then same at least one kinematic component of downhole tool motion;

a signal system, positionable at a remote location from the origination point, comprising:

a remote enable signal generator adapted to generate a remote enable signal; and a transmitter system adapted to relay the remote enable signal; and a control system comprising:

a receiver system adapted to receive the remote enable signal;

a remote disable subsystem, responsive to the receiver system, which places the drive assembly in its disabled mode in response to a designated interruption in reception of the remote enable signal; and a control subsystem, adapted to control the drive assembly in response to a control input from the origination point; and an override lock system having an actuated mode, in which the control subsystem is rendered unresponsive to the control input from the origination point, and a deactuated mode in which the control subsystem is rendered responsive to such input.

75. The system of claim 74 wherein the control subsystem is operable to control the drive assembly independently of the signal system when the override lock system is in its deactuated mode.

76. The system of claim 74 wherein the override lock system comprises an override key that may be rendered inaccessible to personnel at the path origination site.

77. The system of claim 76 wherein the override lock system will remain in the actuated mode so long as the override key remains inaccessible to personnel at the path origination site.

78. The system of claim 76 wherein the override lock system will remain in the deactuated mode so long as the override key remains accessible to personnel at the path origination site.

79. The system of claim 78 wherein the override lock system is further adapted to disable the remote disable system in response to deactuation of the override lock system.

* * * * *